US008997617B2

(12) United States Patent
Thomson

(10) Patent No.: US 8,997,617 B2
(45) Date of Patent: Apr. 7, 2015

(54) PUNCH ASSEMBLY WITH QUICK ATTACH PUNCH POINT AND STRIPPER PLATE REMOVABLY SECURE THEREON

(75) Inventor: Steve H. Thomson, Milaca, MN (US)

(73) Assignee: Mate Precision Tooling, Inc., Anoka, MN (US)

( * ) Notice: Subject to any disclaimer, the term of this patent is extended or adjusted under 35 U.S.C. 154(b) by 486 days.

(21) Appl. No.: 13/419,714

(22) Filed: Mar. 14, 2012

(65) Prior Publication Data

US 2013/0240615 A1 Sep. 19, 2013

(51) Int. Cl.
*B26F 1/14* (2006.01)
*G06K 1/00* (2006.01)
*B21D 28/24* (2006.01)

(52) U.S. Cl.
CPC ..... *B21D 28/246* (2013.01)

(58) Field of Classification Search
CPC ..... B21D 28/34; B21D 37/04; B21D 45/006; B21D 28/346; B26F 1/14
USPC ..... 83/686, 698.91, 684, 698, 699.51, 83/699.61, 699.31, 697, 651, 598.11, 83/698.21, 679; 234/94; 29/426.1
See application file for complete search history.

(56) References Cited

U.S. PATENT DOCUMENTS

| | | | | |
|---|---|---|---|---|
| 1,291,640 | A | 1/1919 | Desmond | |
| 2,160,676 | A | 5/1939 | Richard | |
| 2,618,940 | A * | 11/1952 | Wyzenbeek | 464/52 |
| 3,436,086 | A * | 4/1969 | Glenzer | 279/30 |
| 3,945,653 | A * | 3/1976 | Falchle | 279/97 |
| 3,974,728 | A | 8/1976 | Herlan | |
| 4,862,782 | A | 9/1989 | Ernst | |
| 5,081,891 | A | 1/1992 | Johnson | |
| 5,647,256 | A | 7/1997 | Schneider | |
| 5,746,104 | A | 5/1998 | Russell | |
| 5,752,424 | A * | 5/1998 | Rosene et al. | 83/686 |
| 5,832,798 | A | 11/1998 | Schneider | |
| 5,839,183 | A | 11/1998 | Powlett | |
| 5,839,341 | A | 11/1998 | Johnson | |
| 5,884,546 | A | 3/1999 | Johnson | |
| 5,934,165 | A | 8/1999 | Chatham | |
| 2,172,272 | A | 9/1999 | Booth | |
| 6,047,621 | A | 4/2000 | Dries | |
| 6,131,430 | A | 10/2000 | Schneider | |
| 6,196,103 | B1 | 3/2001 | Schneider | |
| 6,334,381 | B1 | 1/2002 | Chatham | |
| 6,895,797 | B2 | 5/2005 | Lowry | |
| 6,981,327 | B2 | 1/2006 | Nordlin | |
| 7,168,364 | B2 | 1/2007 | Schneider | |

(Continued)

FOREIGN PATENT DOCUMENTS

| | | | |
|---|---|---|---|
| DE | 19643194 | A1 | 4/1998 |
| DE | 19949554 | A1 | 5/2001 |

(Continued)

*Primary Examiner* — Ghassem Alie
(74) *Attorney, Agent, or Firm* — James V. Harmon; Nikolai & Mersereau, P.A.

(57) ABSTRACT

A punch assembly for a turret punch press having a two piece reciprocally movable punch member that has a punch point insert removably attached to a punch driver that allows replacement of the punch point insert without the need to extract the punch member from its punch guide. A locking assembly having four vertical guideways containing slider strips for coupling the punch point insert to the punch driver ensures precision registration of the punch point insert with its driver.

15 Claims, 10 Drawing Sheets

(56) References Cited

U.S. PATENT DOCUMENTS

| | | | |
|---|---|---|---|
| 7,194,820 | B2 | 3/2007 | Schweiger |
| 7,484,312 | B2 | 2/2009 | Morgan |
| D592,685 | S | 5/2009 | Ferry |
| 7,658,134 | B2 | 2/2010 | Morgan |
| 7,726,554 | B2 | 6/2010 | Thielges |
| 7,913,618 | B2 | 3/2011 | Ferry |
| 7,914,241 | B2 | 3/2011 | Ferry |
| 7,954,404 | B2 | 6/2011 | Thielges |
| 7,975,523 | B2 | 7/2011 | Schneider |
| 7,975,587 | B2 | 7/2011 | Schneider |
| 2002/0007714 | A1 | 1/2002 | Ohtsuka |
| 2004/0255742 | A1 | 12/2004 | Morehead |
| 2006/0169118 | A1 | 8/2006 | Morehead |
| 2007/0101849 | A1 | 5/2007 | Moellering |
| 2009/0266209 | A1 | 10/2009 | Thielges et al. |
| 2010/0107832 | A1 | 5/2010 | Johnston |
| 2010/0107846 | A1* | 5/2010 | Lee et al. ..... 83/686 |
| 2011/0119881 | A1 | 5/2011 | Lee et al. |
| 2011/0247467 | A1 | 10/2011 | Johnson |

FOREIGN PATENT DOCUMENTS

| | | | |
|---|---|---|---|
| DE | 10030614 | A1 | 1/2002 |
| DE | 10060339 | A1 | 6/2002 |
| DE | 10261748 | A1 | 7/2004 |
| EP | 1406752 | B1 | 6/2002 |
| WO | WO8911932 | A1 | 12/1989 |
| WO | WO02/45924 | A1 | 6/2002 |

* cited by examiner

PUNCH ASSEMBLY WITH QUICK ATTACH PUNCH POINT AND STRIPPER PLATE REMOVABLY SECURE THEREON

BACKGROUND OF THE INVENTION

I. Field of the Invention

This invention relates generally to high speed metal punching equipment suited for installation in a turret-style punch press and more particularly to the design of a punch assembly used in such equipment that allows for quick removal of a worn punch insert from the punch guide for refurbishment and return or replacement.

II. Discussion of the Prior Art

To provide increased mean-time-to-repair of punch assemblies used in high-speed CNC controlled turret punch presses, it has proved expedient to employ a high-grade high speed steel insert such as American National Standards Institute M2 steel punch point insert affixed to the end of a lower cost steel punch driver to reduce cost of the punch press assembly. Notwithstanding the use of such a high-grade and relatively expensive punch point insert, after a period of use in punching holes through sheet steel and other metals, it becomes necessary to replace the punch point insert with a new or resharpened one. To reduce the downtime of the turret punch press for such punch point insert replacement, it is desirable that an operator be able to perform this task in a minimum amount of time and most preferably without the need for special hand tools.

In prior art punch assemblies having a two-piece driver/insert combination, it has generally been necessary to first remove the punch driver and insert from the upper end of the punch guide and subsequently remove the punch insert from the punch driver so that the punch point insert can be replaced with a new or refurbished unit. The present invention makes possible reduced manufacturing costs, such as machining expenses e.g. through the use of stamped components while at the same time simplifying punch point replacement by providing a way to releasably clamp the stripper member to the end of the punch guide and the punch point insert to the punch driver. The clamping mechanism employed is most preferably actuated by hand and in most cases without the need for any special tools or without the need to remove the punch driver and insert from the punch guide.

SUMMARY OF THE INVENTION

The present invention provides a punch assembly for a turret punch press comprising an outer, generally cylindrical punch guide having a cylindrical bore extending longitudinally therethrough from an upper end to a lower end. Contained within the bore of the guide or housing is a punch driver that is reciprocally movable within the bore. Releasably affixed to the lower end of the punch driver, preferably by one or more flexible stamping elements, is a punch insert having a punch point of a predetermined shape at a lower end thereof.

Affixed to the upper end of the punch driver is a canister assembly which includes a cylindrical, tubular housing containing a compression spring for normally biasing the punch driver to a retracted disposition within the bore.

Formed inward from a peripheral surface of the generally cylindrical punch driver and extending longitudinally are a plurality of guideways in which are fitted a corresponding plurality of locking sliders which can be stampings shaped to engage the punch insert and lock same to the punch driver when the locking sliders are in a first disposition within the guideways and to disengage from the punch insert when in a second disposition within the guideways. Cooperating with the plurality of locking sliders is a lock collar that is concentrically disposed on the punch driver and rotatable through a predetermined arc between a locked disposition and an unlocked disposition relative to the locking sliders.

The stripper member for the punch assembly, which itself can be a metal stamping of substantially uniform thickness throughout, is releasably clamped to the punch guide at a lower end thereof most preferably by leaf spring elements, and it includes an aperture conforming in shape to the punch point of the punch insert allowing the punch point to extend through the aperture in the stripper member upon application of a force to the canister assembly that exceeds the return force offered by the compression spring. The clamping structure holding the stripper member to the bottom of the punch press guide is also manually actuatable without the need for any special tools to unclamp and reclamp the stripper member from and onto the punch guide.

DESCRIPTION OF THE DRAWINGS

The foregoing features, objects and advantages of the invention will become apparent to those skilled in the art from the following detailed description of a preferred embodiment especially when considered in conjunction with the accompanying drawings in which like numerals in the several views refer to corresponding parts.

DESCRIPTION OF THE PREFERRED EMBODIMENT

Figure 1:
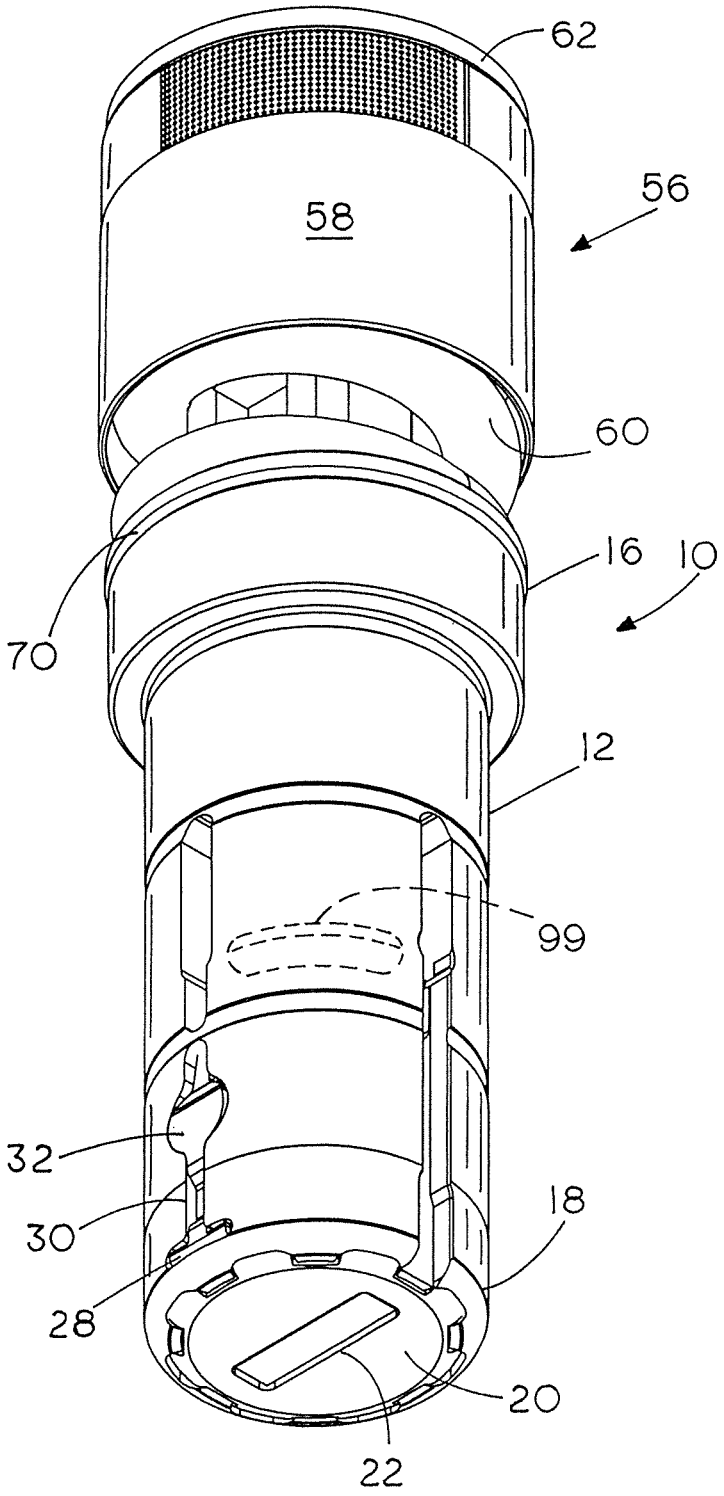
FIG. 1 is an isometric view of a preferred embodiment of a punch assembly from a high speed turret punch constructed in accordance with the present invention.

This description of the preferred embodiments is intended to be read in connection with the accompanying drawings, which are to be considered part of the entire written description of this invention. In the description, relative terms such as "lower", "upper", "horizontal", "vertical", "above", "below", "up", "down", "top" and "bottom" as well as derivatives thereof (e.g., "horizontally", "downwardly", "upwardly", etc.) should be construed to refer to the orientation as then described or as shown in the drawings under discussion. These relative terms are for convenience of description and do not require that the apparatus be constructed or operated in a particular orientation. Terms such as "connected", "connecting", "attached", "attaching", "join" and "joining" are used interchangeably and refer to one structure or surface being secured to another structure or surface or integrally fabricated in one piece, unless expressively described otherwise.

As shown in FIG. 1, the punch assembly is indicated generally by numeral 10. It comprises an outer, generally cylindrical punch guide 12 which, as shown in the cross-sectional views of FIGS. 8-10, includes a cylindrical bore 14 that extends longitudinally therethrough from the guide's upper end 16 toward, but short of its lower end 18. A counter bore 19 of a slightly greater diameter than that of bore 14 extends inward from the lower end 18 as can be seen in FIG. 9.

Figure 10:
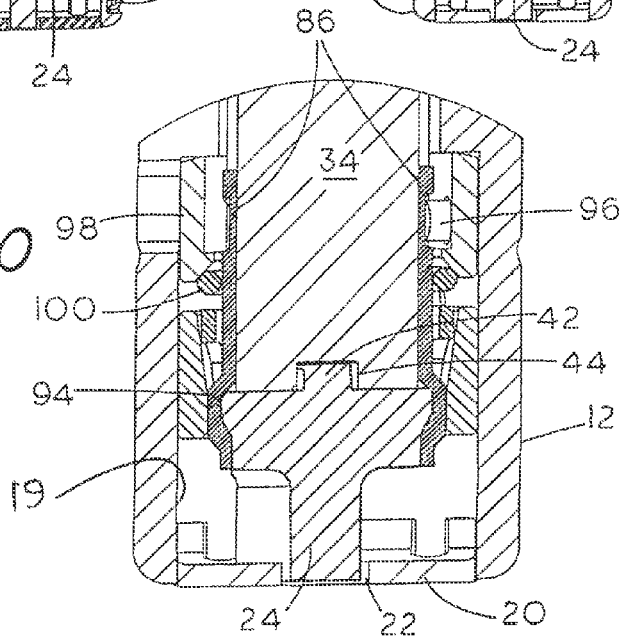
FIG. 10 is an enlarged detail view of the lower end of FIG. 9.

Releasably secured to the lower end 18 of the punch guide 12 is a stripper member 20 in the form of a generally circular plate which can be a metal stamping of substantially uniform thickness throughout that requires minimal machining and has a central aperture 22 conforming in shape to that of a punch point 24, as can be best seen in the enlarged cross-sectional view of FIG. 10.

Figure 2:
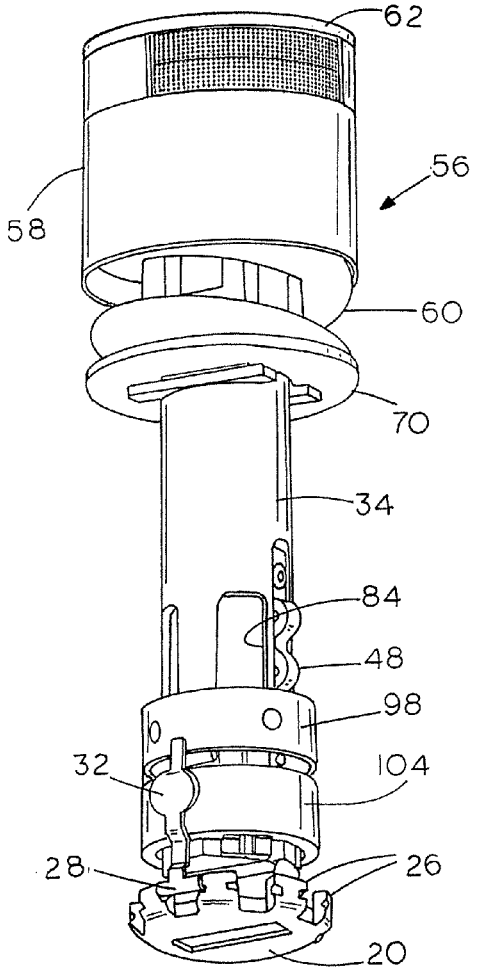
FIG. 2 is an isometric view as in FIG. 1 but with the outer punch guide removed.

As seen in FIG. 2, the stripper member 20 has an annular sidewall provided with a plurality of regularly spaced upwardly extending tabs 26 formed around the periphery thereof that are adapted to fit into a corresponding pattern of recesses formed in the bottom end 18 of the guide 12 and to be engaged by a pair of leaf spring retainer clips 28 which can be metal stampings that fit into recesses 30 that are machined into the sidewall of the guide 12. Only one such recess is visible in the view of FIG. 1, the other being on a diametrically opposed location as depicted in the cross-sectional view of FIG. 8. The configuration of the leaf spring retainer clip is such that depression of a pad portion thereof, identified by numeral 32 in FIG. 1, further into the recess 30 will cause the lower end thereof that engages the tabs 26 to deflect radially outward so as to no longer engage the tabs and allows the stripper member 20 to be removed from the bottom end 18 of the punch guide 12.

Figure 8:
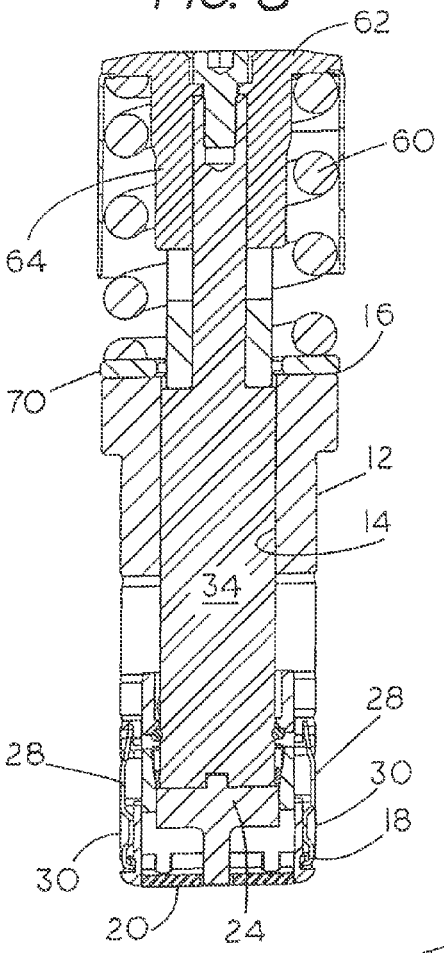
FIG. 8 is a cross sectional view of the embodiment of FIG. 1 taken along the XY plane.
Figure 9:
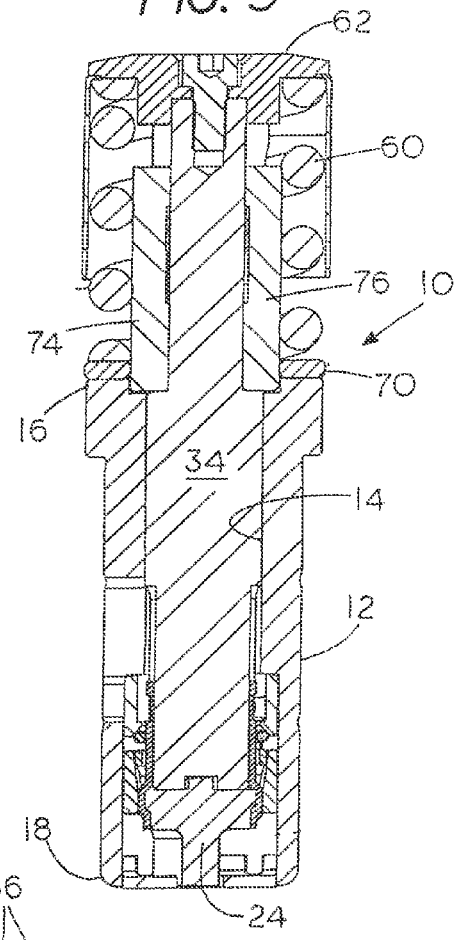
FIG. 9 is a cross sectional view of the embodiment of FIG. 1 taken along the YZ plane.

Referring again to the cross-sectional views of FIGS. 8-10, there is disposed within the longitudinal bore 14 and counter bore 19 of the punch guide a two-piece, reciprocally movable combination of a punch driver 34 in its cooperative relationship with the punch point insert 24. The punch driver 34 is preferably formed from relatively low-cost steel while the punch point insert 24, preferably fabricated from high grade steel such as powdered metal or tungsten carbide that is pressed, formed or machined into a desired shape. While a tungsten carbide insert increases the cost, because it is approximately three times stiffer than steel and is much denser than steel or titanium, it makes for a longer wearing tool that is highly abrasion resistant and capable of withstanding higher temperatures than standard high speed steel tools. It is also well recognized that tungsten carbide is capable of maintaining a sharp cutting edge in a way that is superior to other tools.

The shape configuration of the punch point insert can be discerned from the views of FIGS. 7A-7D. Here, the punch point insert is illustrated as a rectangular edge and will produce a rectangular slug upon being made to descend through a sheet metal workpiece. Of course, other shapes are achievable by modifying the shape of the downwardly depending portion 38 of the punch point insert 24.

Figure 7A:
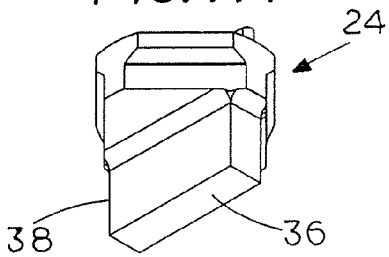
FIGS. 7A-7D, respectively, show a perspective view, a side view, a top view and a bottom view of the punch insert with FIG. 7C also showing the position of alignment strap 48.
Figure 7B:
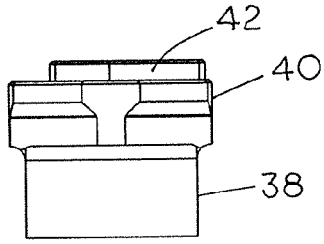
Figure 7C:
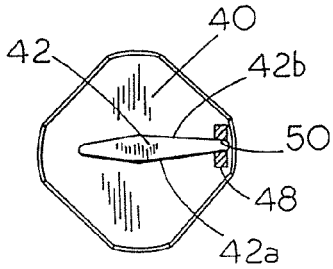
Figure 7D:
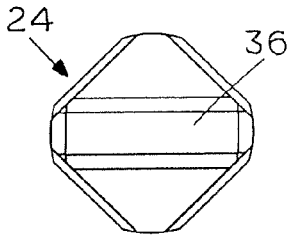

In FIGS. 7B and 7C, the punch point insert is shown to have a generally rectangular head portion 40, but with radiused corners, and projecting upwardly therefrom is a somewhat diamond-shaped protuberance 42 that is designed to fit within a recess 44 formed in the bottom surface of the punch driver as best seen in the enlarged cross-sectional view of FIG. 10. If desired, the protuberance can be on the punch driver and the recess in the insert. To maintain a desired angular orientation between the punch point insert 24 and the punch driver 34, a longitudinally extending groove 46 is formed inward from the peripheral surface of the punch driver as seen in FIG. 3, and fitted into this groove is a leaf spring alignment strap 48 having a notch 50 that is arranged to straddle the tapered protuberance 42 (FIG. 7C) and apply a centrally directed bending force for yieldably engaging punch point ramp surfaces 42*a* and 42*b* which are slanted relative to one another so as to maintain the desired exact rotative registration of the insert about a vertical axis with no clearance unlike an ordinary pin or key which require clearance.

Figure 3:
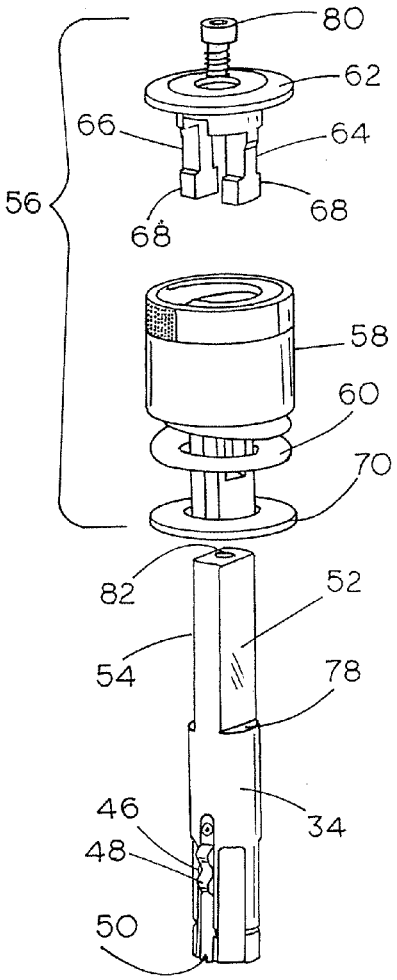
FIG. 3 is an exploded perspective view showing the manner of attachment of the punch canister to the punch driver.
Figure 4:
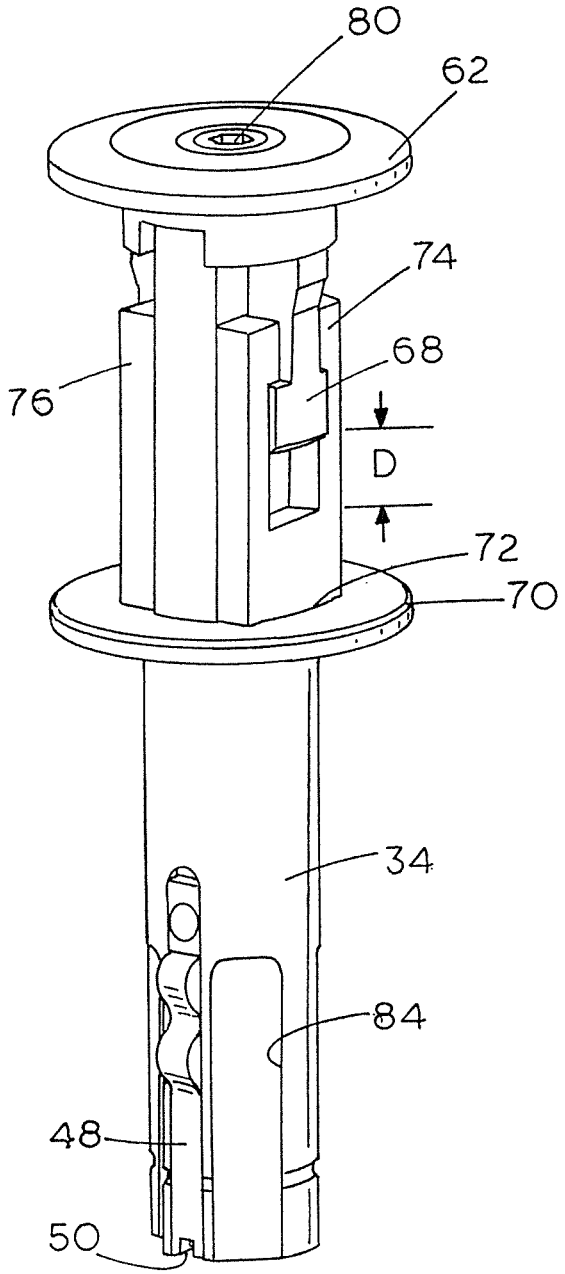
FIG. 4 is a perspective view shown with the canister cover and return spring removed to better illustrate the mode of attachment of the canister assembly with a punch driver.

With continued reference to the exploded view of FIG. 3, the punch driver 34 has opposed flat abutment surfaces 52 and 54 machined therein on which a canister assembly, indicated generally by numeral 56, is adapted to be secured. With reference to FIGS. 2-4, the canister assembly is seen to comprise a cylindrical, tubular housing 58 having an inside diameter that is sized to fit over the outer diameter of a relatively stiff compression spring 60. Fitted atop the cylindrical housing 58 is a punch head 62 that has a pair of spaced-apart, downwardly depending legs 64, 66 where the legs terminate in transversely extending feet 68 as shown. The canister assembly further includes a spring retainer plate 70 consisting of a circular plate having a central aperture 72. Fitted through the aperture 72 is a pair of couplers 74 and 76 that are generally U-shaped, with the legs of the "U" extending upwardly as seen in FIG. 4 and also having feet that are designed to engage the feet 68 on the legs 64 and 66 that are integrally formed with and project downward from the punch head 62. The spring retainer plate 70 is designed to rest upon the upper end of the punch guide 12, as seen in FIG. 1. Couplers 74 and 76 slide in and out radially in retainer plate 70 aperture to allow for assembly with punch head 62. When so positioned, the flattened portions 52 and 54 of the punch driver 34 above the shoulder 78 fit between the couplers 74 and 76 thereby locking them radially outward to maintain engagement with punch head 62 feet 68. A flathead cap screw 80 fits through an aperture in the punch head 62 and is screwed into a threaded bore 82 formed inward from the top surface of the punch driver 34.

From what is described, it can be recognized that a mechanical or electro mechanical ram forming part of the turret punch imparts a downward force on the punch head 62, it will drive the punch driver 34 downward through the aperture in the spring retainer plate 70 of the canister by a distance, D, shown in FIG. 4 and which is sufficient to penetrate through a sheet metal workpiece positioned adjacent the stripper member 20. When this driving force is removed, the return spring 60 acting between the spring retainer plate 70 and the punch head 62 will function to move the punch driver 34 in the upwards direction such that the punch point insert will no longer extend through the aperture 22 in the stripper member 20.

Without limitation, the return spring 60 follows Hook's Law for springs.

Next to be described is the structure for releasably securing the punch point insert 24 to the punch point driver 34 and, in this regard, reference will be made primarily to FIGS. 5, 6 and 8-10 of the drawings.

Figure 5:
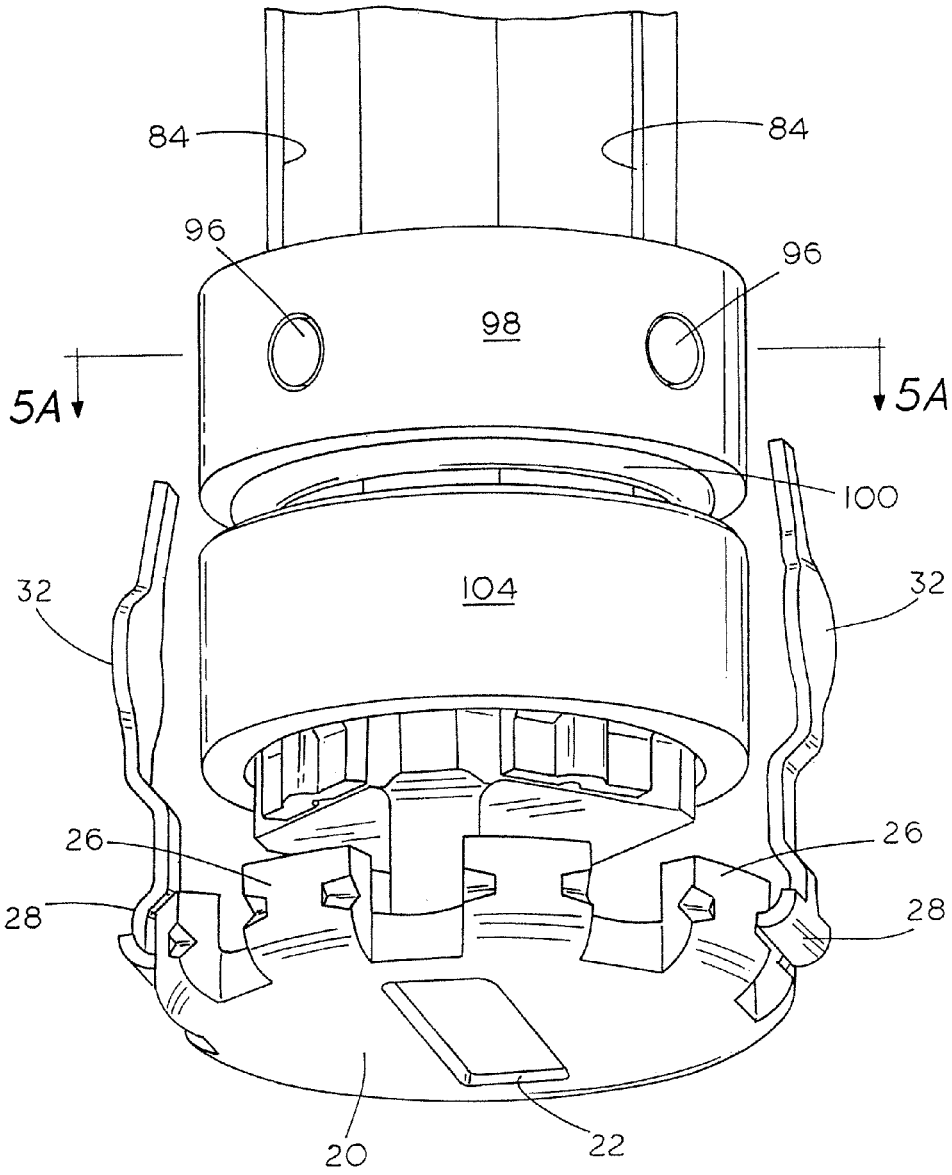
FIG. 5 is a detailed perspective view of the structure releasably securing the punch insert to the punch driver.
Figure 5A:
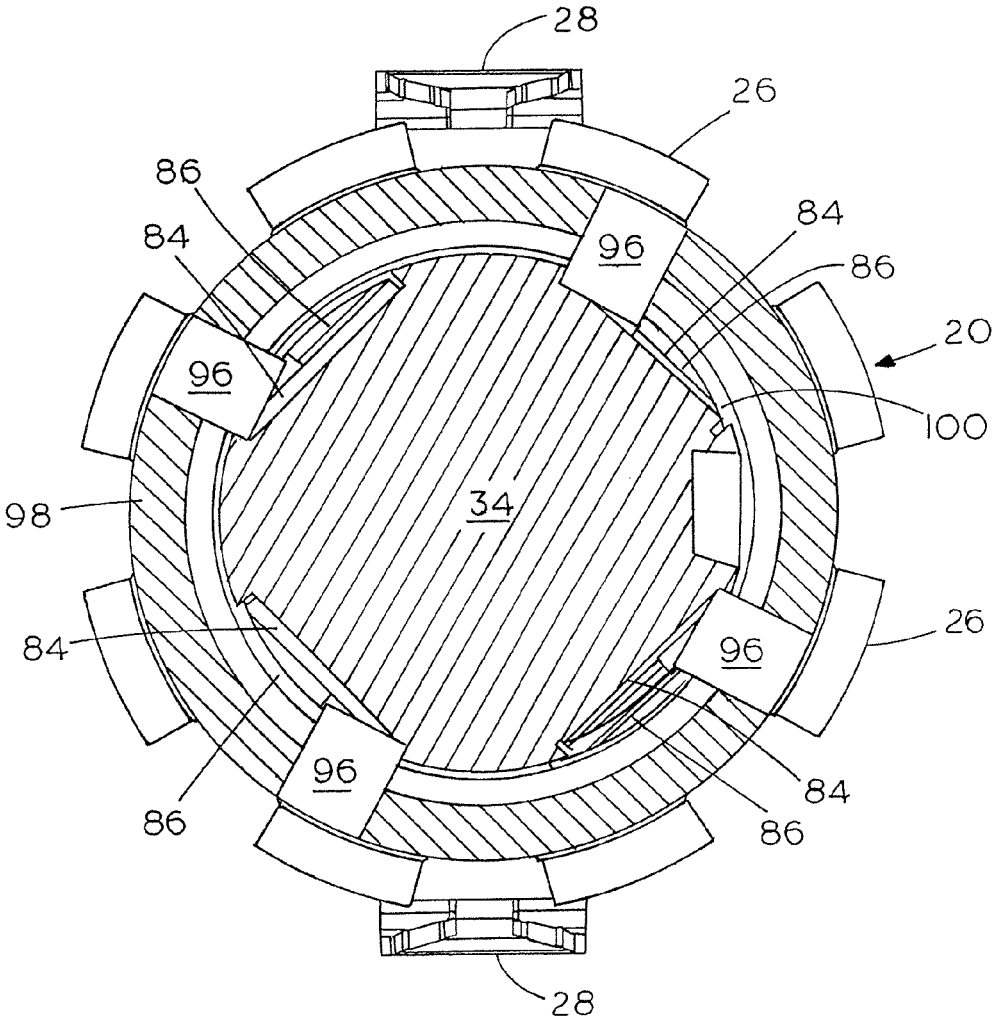
FIG. 5A is a horizontal cross-section taken on line 5A-5A of FIG. 5.
Figure 6:
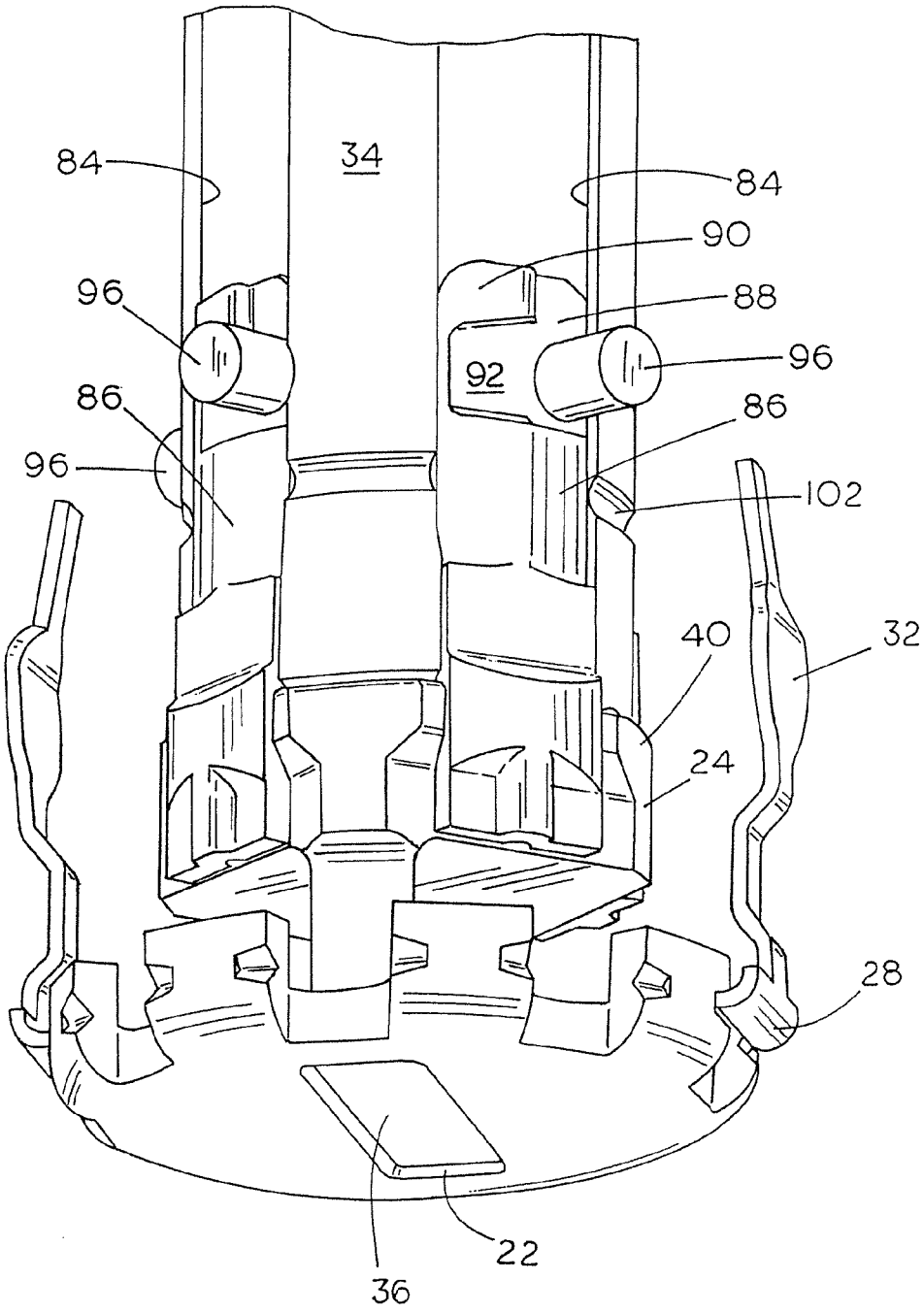
FIG. 6 is a view like that of FIG. 5, but with the lock collar, retaining ring and centering collar removed to show underlying parts.
Figure 6A:
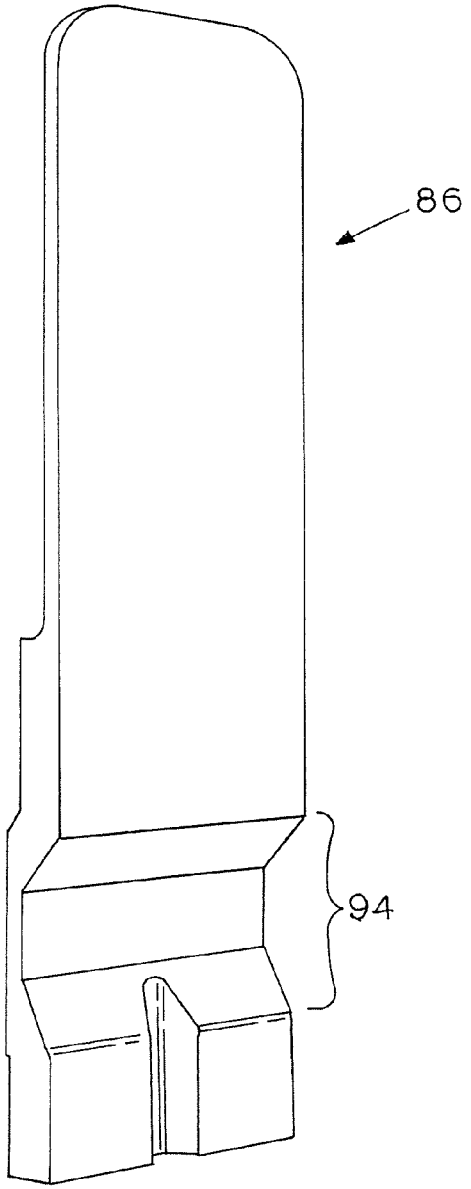
FIG. 6A is a rear perspective view of a vertical slider strip component.

Referring now to the enlarged partial view of FIG. 5 and cross-sectional view of FIG. 5A, there are formed inward from the cylindrical surface of the punch driver 34 four guideways, as at 84, milled or ground at 90° radial spacings thereabout. These four grooved guideways are adapted to receive four vertical slider strips which can be metal stampings that require little machining, two of which are visible in the view of FIG. 6 and are identified by numerals 86. The exposed surface thereof as seen in FIG. 6 is slightly rounded so as to conform to the cylindrical profile of the punch driver 34 and includes a flat facing zone 88 that extends about half of the distance across the width dimension of the vertical slider strip and a raised zone 90 extending across the remaining half of the strip's width dimension. Formed in the raised zone 90 is a notched-out portion 92. FIG. 6A is a rear perspective view of the vertical slider strip 86 and it is configured to exhibit a notched-out region 94 adapted to fit about the head portion 40 of the punch point insert 24 in the manner shown in FIG. 6.

Each of the slider strips 86 has associated with it a cylindrical pin as at 96. The inner ends of these pins are adapted to contact either the flat portion 88 of the slider strip or the notched-out portion 92 thereof. As seen in FIGS. 5 and 5A, the pins 96 fit into apertures formed radially through a toroidal lock collar 98 that is supported by an annular, C-shaped retaining ring 100 designed to reside in the annular groove 102 formed in the punch driver 34 as seen in FIG. 6. The retaining ring 100 prevents the lock collar 98 from moving longitudinally downward along the punch driver.

From the drawings of FIGS. 5, 5A and 6, it can be appreciated that when the locking collar is rotated about a vertical axis, the pins 96 may be repositioned so as to either reside on the flat surface 88 or have its end disposed in the notched-out portion 92 of the vertical slider strip. With the pins 96 residing on the flat portion 88, as the punch point insert 24 is manually pulled downward, the vertical slide strip is able to move with it to the point where the notched-out region 94 on the back surface of the strip 86 no longer locks to the insert and it can be pulled free of the punch point driver 34. However, when the locking collar is rotated manually, e.g. through a port 99 in the guide 12 (FIG. 1) so as to reside in the notched-out portion 92, the vertical slider strip is unable to be displaced within its slot 84 and the notched-out portion 94 continues to lock the punch point insert 24 to the bottom surface of the driver 34.

Figure 11:
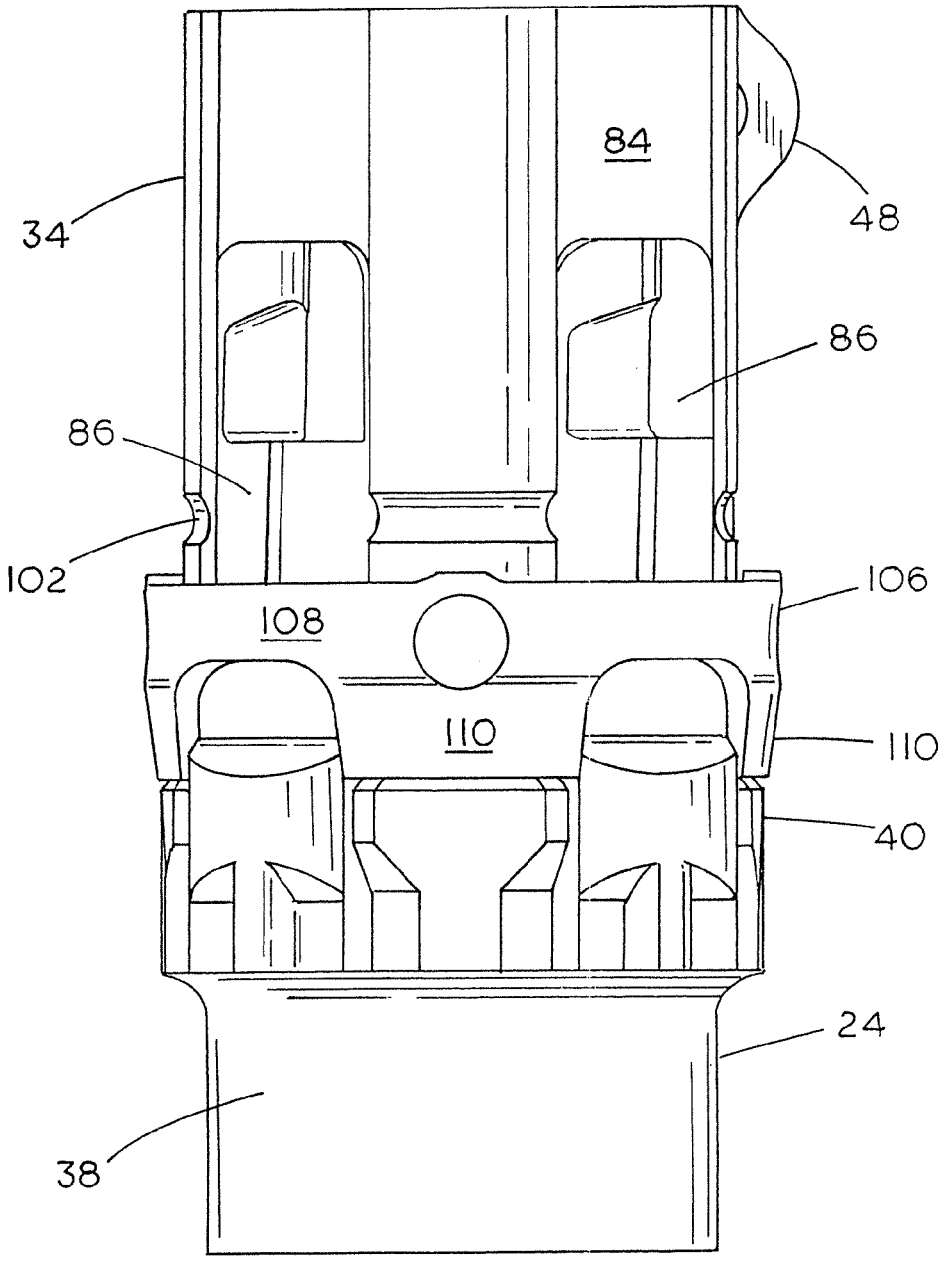
FIG. 11 is a detailed view showing the placement of the cone collar.
Figure 12:
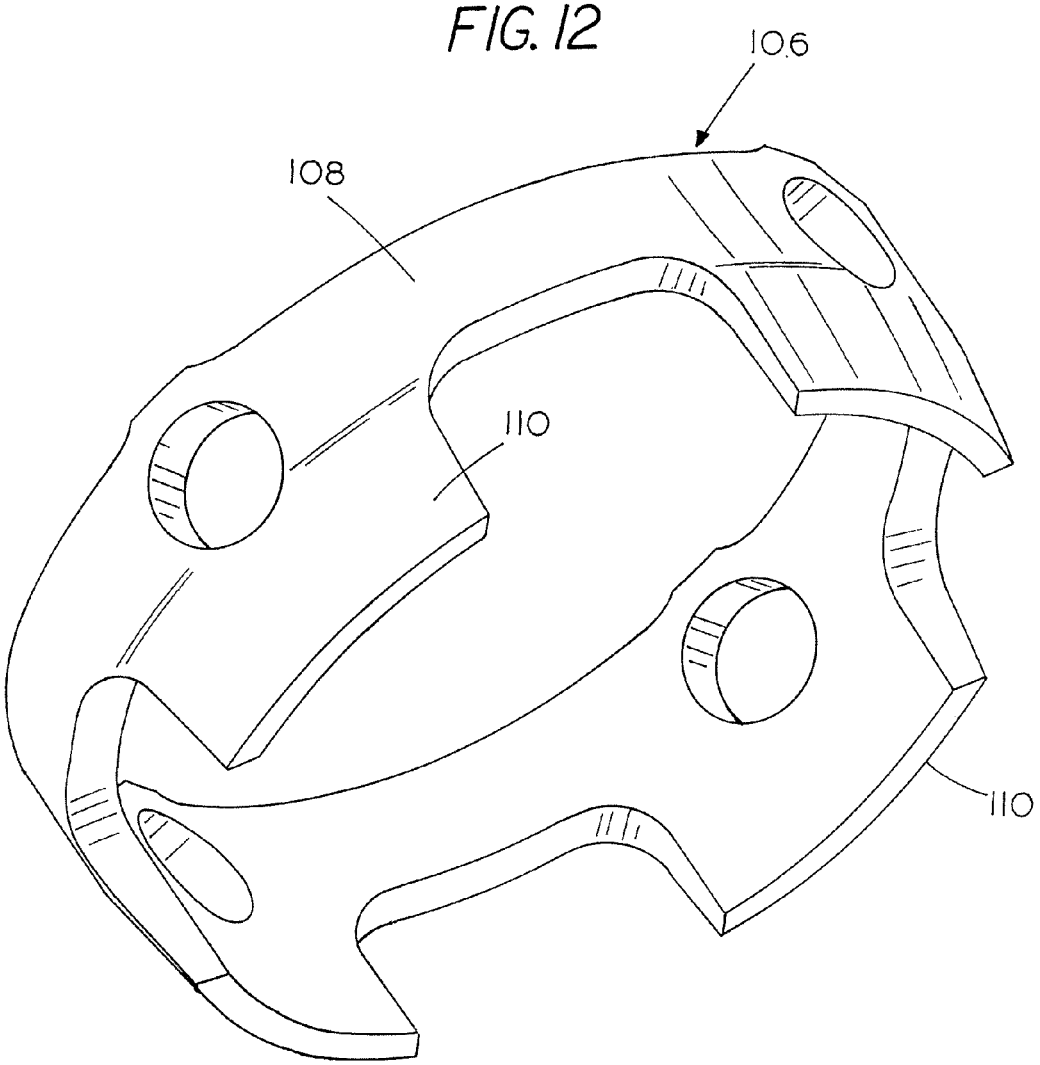
FIG. 12 is a perspective view of the cone collar component.

Hidden from view in FIG. 5 by a centering collar 104, but visible in the partial view of FIG. 11, is a cone collar 106 that is shown by itself in FIG. 12. As seen in FIGS. 11 and 12, the cone collar 106 is machined so as to have an upper ring portion 108 with four downwardly projecting and inwardly tapered teeth 110 and when assembled onto the punch driver 34 in surrounding relationship with respect to the four slider strips 86, the teeth are seen to fall between adjacent ones of the strips 86 and rest upon the inside conical surface of the centering collar 104. The cone collar 106 and the centering collar 104 work together to create a high precision centering feature. The centering collar 104 has a precision cylindrical fit with respect to the cone collar 106 and the cone collar itself has a precision cylindrical fit with the punch driver 34 which, in turn, has a precision cylindrical fit with the ID of the bore 14 of the punch guide 12. In addition, the slide strips 86 are forced outward on the bottom end due to the ramping action caused by the sliders 86 notched-out portion 94 against angled ramps #95 (FIG. 10) on insert 24 as collar 98 is rotated such that pins 96 enter area 92 against ramping edge #97 (FIG. 6) on sliders 86 to securely hold punch insert and sliders in the up position. To provide extremely precise centering, the outward force of the ramps is further advantaged, by pressing outwardly against the centering collar 104. The circular area on the perimeter of the centering collar not being pushed against by the sliders then react equally and opposite thus sway inwardly against the cone collar. This provides a precise centering mechanism not achievable with normal bore and shaft connections.

In that the stripper 20 is stamped with curled-up fingers 26 for positioning into the punch guide, it is designed such that the operator can remove the stripper before the punch insert is removed, thus obviating the need for the operator to pull the canister assembly 56 off the punch guide as required by known prior art designs just to change the punch insert.

This invention has been described herein in considerable detail in order to comply with the patent statutes and to provide those skilled in the art with the information needed to apply the novel principles and to construct and use such specialized components as are required. However, it is to be understood that the invention can be carried out by specifically different equipment and devices, and that various modifications, both as to the equipment and operating procedures, can be accomplished without departing from the scope of the invention itself.

What is claimed is:

1. A punch assembly for a turret punch press, comprising:

(a) an outer, generally cylindrical punch guide having a cylindrical bore extending longitudinally therethrough from an upper end to a lower end;

(b) a punch driver disposed within the cylindrical bore of the punch guide and reciprocally movable therein;

(c) a punch insert releasably affixed to a lower end of the punch driver and having a punch point of a predetermined shape at a lower end thereof;

(d) a spring assembly affixed to an upper end of said punch driver, the spring assembly containing a compression spring for normally biasing the punch driver in an upward direction;

(e) a plurality of elongate locking sliders fitted into a corresponding plurality of longitudinally extending grooves formed inward from a peripheral surface of the punch driver where the plurality of locking sliders are formed to engage the punch insert and lock same to the punch driver when the locking sliders are in a first, elevated, disposition within the grooves and to disengage from the punch insert when in a second, lowered, disposition within the grooves; and (f) a lock collar concentrically disposed on the punch driver and rotatable through a predetermined arc between a first disposition where the locking sliders are precluded from sliding within their groove and an unlocked disposition where the locking sliders are able to slide within their grooves.

2. The punch assembly as in claim 1 and further including a retaining ring encircling the punch driver for supporting the lock collar against longitudinal displacement.

3. The punch assembly as in claim 1 wherein a protuberance on the punch insert or the punch driver is adapted to fit within a recess in the other of said punch driver or punch insert.

4. The punch assembly as in claim 1 wherein the lock collar comprises a toroid having spaced apertures formed through a sidewall thereof and a pin fitted into the apertures that engage the locking sliders.

5. The punch assembly as in claim 3 and further including an orientation key recess on one of the punch driver or punch insert to and releasably engage the protuberance on the other of said punch driver or punch insert for holding the punch insert relative to the bottom surface of the punch driver in a desired orientation.

6. The punch assembly as in claim 2 and further including a centering collar encircling the punch driver at a location vertically offset below the locking collar and wedged between an inner diameter of the punch guide and a portion of the locking sliders that engage the punch insert.

7. The punch assembly as in claim 1 and further including a stripper member releasably clamped to the punch guide at the lower end, the stripper member comprising a circular disk having an aperture conforming in shape to the punch point of the punch insert.

8. The punch assembly as in claim 7 wherein the stripper member is releasably clamped by at least one spring retainer clip.

9. The punch assembly of claim 7 wherein the spring assembly comprises a cylindrical, tubular housing having an inside diameter sized to receive an outer diameter of the compression spring therein;

an upper punch head having spaced-apart downwardly depending legs with transversely extending feet;

a spring retainer comprising a circular plate having a central aperture and adapted to be supported by the upper end of the guide member;

at least one coupler for joining the spring retainer to the feet of the punch head where the pair of couplers extend through the central aperture of the spring retainer, a center opening of the coil spring and straddle an upper portion of the punch driver therebetween; and a screw passing through an aperture in the punch head and into a threaded bore formed in an upper end surface of the punch driver.

10. The punch assembly of claim 9 wherein a force applied to the punch head in excess of the spring force of the compression spring drives the punch point of the punch insert through the aperture of the stripper member.

11. The punch assembly of claim 1 wherein the punch guide includes an annular slot through which the locking collar is accessible for permitting rotation thereof through said predetermined arc.

12. The punch assembly of claim 1 wherein the locking sliders comprise stamped elongate metal strips of a predetermined width, a first side of which is planar along a length dimension over about half of the width and is arcuate over the remaining portion of the width and a second side of which includes a recess for selectively engaging the punch insert.

13. The punch assembly of claim 7 wherein the stripper is a generally flat metal disc with a plurality of radially spaced fingers projecting generally perpendicular to the flat metal disc about the periphery thereof.

14. The punch assembly of claim 13 wherein the leaf spring retainer clips are metal stampings having a pad area intermediate a first end and a second end and with an arcuate hook at the second end for engaging adjacent ones of the plurality of fingers.

15. The punch assembly of claim 1 including at least one longitudinally extending alignment strip for maintaining circumferential registration of the punch driver during reciprocation of the punch driver.

* * * * *